US006150592A

United States Patent [19]

Casper

[11] Patent Number: 6,150,592

[45] Date of Patent: Nov. 21, 2000

[54] MULTIPLE-STRINGED MUSICAL INSTRUMENT WITH LEVERS CONTROLLING INDIVIDUAL STRINGS

[76] Inventor: David Brian Casper, 702 14th Ave E., Seattle, Wash. 98112

[21] Appl. No.: 09/317,709

[22] Filed: May 24, 1999

[51] Int. Cl.[7] ..... G10D 3/14

[52] U.S. Cl. ..... 84/312 R; 84/312 P; 84/315

[58] Field of Search ..... 84/312 R, 312 P, 84/315, 316, 317, 318

[56] References Cited

U.S. PATENT DOCUMENTS 1,392,053 9/1921 Harrington ..... 84/319

3,479,917 11/1969 Zitnik, Jr. et al. ..... 84/313

5,173,565 12/1992 Gunn ..... 84/307

*Primary Examiner*—David Martin

*Assistant Examiner*—Shih-yung Hsieh

[57] ABSTRACT

Levers are used on a multiple-stringed musical instrument to enable the player, while performing, to raise and lower the pitches of individual strings. Finger pressure upon the levers, by tightening or slackening individually selected strings, can be used to both raise and lower the pitches of strings from their rest tunings selectively, simultaneously, and independently of each other. This can be done while leaving other strings in their rest tunings. Increasing pressure on a rod results in increasing deviation from the rest tuning, either up or down in pitch, depending on the direction that the pressure is applied.

2 Claims, 3 Drawing Sheets

MULTIPLE-STRINGED MUSICAL INSTRUMENT WITH LEVERS CONTROLLING INDIVIDUAL STRINGS

BACKGROUND OF THE INVENTION a) Field of the Invention

The invention relates to a musical instrument for the playing of strings, specifically playing in such manner that the pitches of strings can be varied up or down independently of each other through changes in string tension via finger pressure applied to levers, all accomplished by the hand which does not pluck or otherwise activate the strings. Secondarily, the invention relates to the above-mentioned musical instrument with the additional characteristic of allowing the player to choose strings' harmonics without the use of hands.

b) Related and Prior Art

The change in tension on a musical string is a widespread playing technique found in many music cultures. On fretted instruments such as guitars, fingers are used to stretch strings to create vibratos and other ornaments. Some electric guitars are provided with a 'tremolo bar' which allows the strings as a group to be tightened or slackened by the string-activating hand (typically the right hand plucking or strumming). This provides a variety of effects and ornaments. But the tremolo bar cannot select individual strings for pitch changing while leaving other strings in their 'rest tuning', defined as that tuning preset by adjustment of the tuning peg. Nor can it slacken one string while tightening another. Further, there is a disadvantage in that the string-activating hand must also do the pitch changing, thereby increasing the difficulty of rendering subtle and accurate control of pitch.

In China and throughout much of Asia there exist zither instruments whose strings can be individually tightened by finger pressure of the non-plucking hand. But in these instruments, strings cannot be slackened from their rest tunings by increasing finger pressure. In Viet Nam there is a folk instrument called dan bau which has only one string, and this string terminates in the side of a rod which is able to slacken and tighten the string. Only one note can sound at a time.

There are pedal instruments which can change the pitches of some chosen group of strings through changes in string tension via the positions of foot pedals. The steel pedal guitar and the orchestral harp are examples. But such pedals are used primarily to change tuning set-ups and have little ornamental use. Nor can either of these instruments make use of variable finger pressure to accomplish wide ranging simultaneous and continuous pitch changes.

No musical device is known in which the player can simultaneously vary the tensions of more than one string independently of each other, up and down from their rest tunings through the application of finger pressure, and in which increasing pressure can result in greater deviation from rest tuning up or down as chosen. Also, no musical device is known in which the player can do all of this and at the same time, without using hands, choose strings' harmonics to be played.

The primary object of the invention is to enable the player to continuously and simultaneously vary the pitches of strings independently of each other, through the application of finger pressure, both up and down from the strings' rest tunings, in such manner that increasing pressure always results in greater deviation from the rest tunings, up or down in frequency as chosen. Another object is to be able to accomplish the previously mentioned object is such manner that the hand which varies the tensions is not the hand which activates the strings. Another object is to accomplish the previously mentioned objects while at the same time playing harmonics without having to use hands to choose the harmonics.

SUMMARY OF INVENTION

The invention comprises a number of strings, each terminating at one end of a supporting structure in a tuning peg and terminating at the other end in a lever which can be moved back and forth so as to continuously adjust the tension on the string. The invention also comprises one or more padded bars, activated without hands, whose purpose it is to touch the strings at harmonic nodes. This allows the player to activate strings and to lower and raise their individual pitches over more than an octave's range, making possible the following techniques:

1) vibratos above, below, and through the rest tunings
2) glissandi below, above, and passing through the rest tunings
3) a variety of continuous pitch variations over a wide range below, through, and above the rest tunings.
4) techniques 1, 2, and 3 applied to strings' harmonics.

Because there are a number of strings, the above mentioned techniques can be applied to more than one string at a time. Since each lever affects only one string, simultaneous pitch changes may be made independently of each other. These pitch changes are accomplished through changes in the pressure of fingers applied to levers. Applying no pressure to the lever results in the rest tuning of the string attached to that lever. Pushing the top of the lever in one direction results in lowering the pitch of the string from its rest tuning while pushing the lever in the opposite direction results in raising the pitch of the string from its rest tuning. Strings and levers are configured such that individual fingers can control individual levers selectively and simultaneously.

DESCRIPTION OF DRAWINGS

1)

2)

3)

4)

5)

6)

7)

8)

9)

10)

11)

Figure 1:
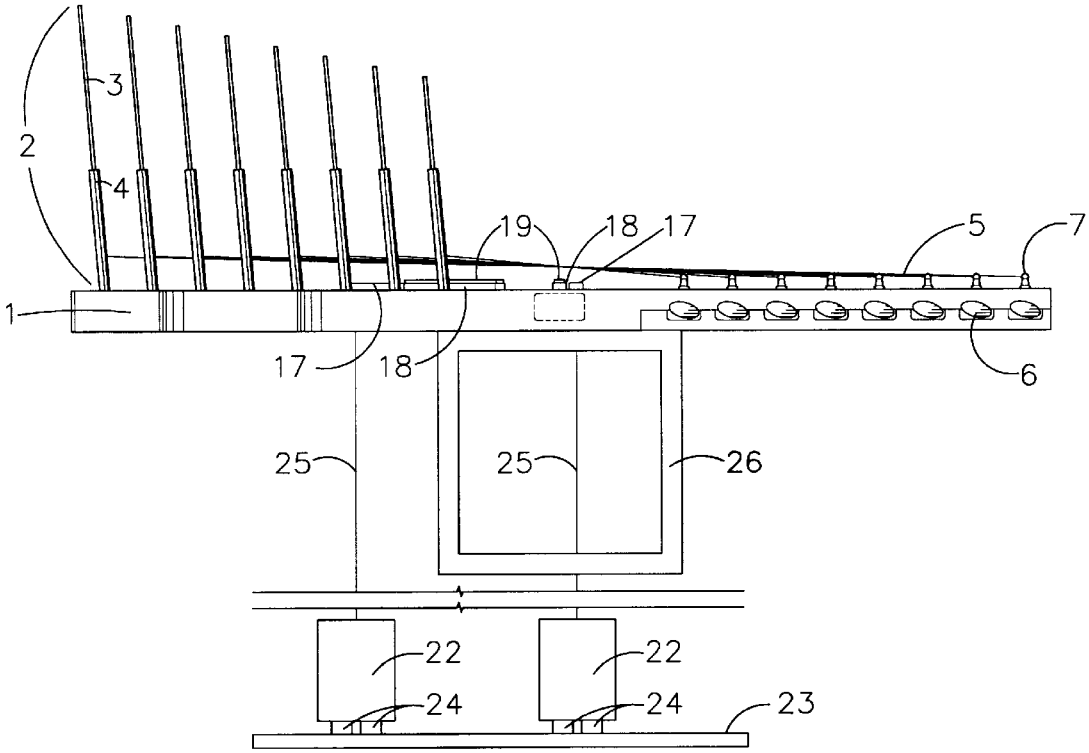
FIG. 1 is a side elevation of the most preferred embodiment and is the side facing the player.

The numbered parts are as follows:

1) body
2) lever
3) ⅛ inch square brass rod
4) ⅜ inch round nylon rod
5) string
6) tuning peg
7) top of tuning peg
8) electric pick-up
9) ⅜ inch inner diameter brass tubing
10) bridge support
11) 5/16 inch diameter steel rod
12) 5/16 inch inner diameter needle bearing
13) felt pad
14) rigid lever, ⅜ inches in diameter
15) pin passing through rigid lever and attached to body
16) spring
17) lifter
18) pad support
19) harmonic node-touching pad
20) pivot pin
21) lifter support hinge
22) pedal
23) pedal support
24) pedal hinge
25) riser
26) leg brace
27) ⅜" diameter hole for embedment of lever
28) trough (¼" deep)
29) harmonic bar assembly
30) harmonic node-touching bar
31) foot control
32) bridge

DETAILED DESCRIPTION

Figure 2:
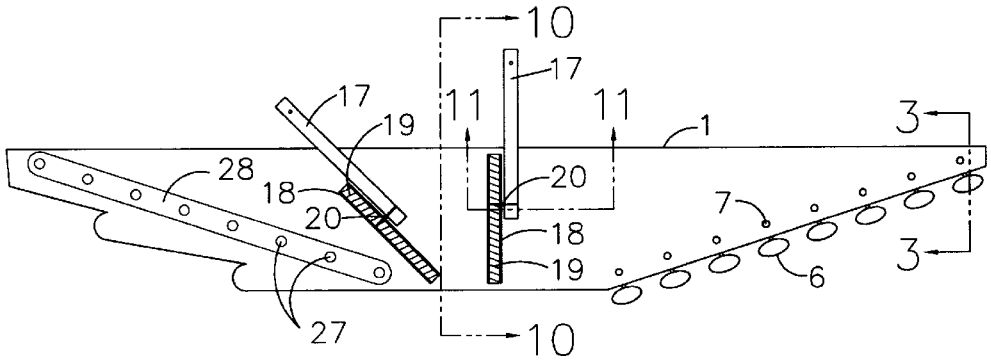
FIG. 2 is a bird's eye view of the most preferred embodiment, minus levers 2, strings 5, electric pick-up 8, and foot control 31.
Figure 10:
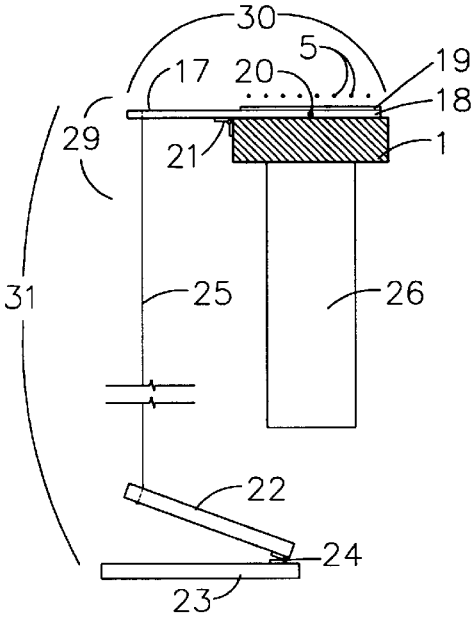
FIG. 10 is a side view elevation, taken from the player's left hand side, of a harmonic bar assembly 29. Strings 5 and body 1 are shown in cross section.
Figure 11:
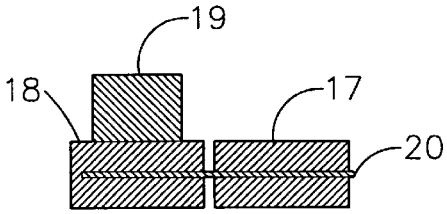
FIG. 11 is an enlargement of the harmonic node-touching bar 30, a player's side cross section where the lifter 17 and pad support 18 are joined by the pivot pin 20.

Refer now to FIGS. 1 and 2 which represent the most preferred embodiment of the multiple-stringed musical instrument. A solid board 1, also referred to as the body 1, 24" long, 3½" wide, and 1½" thick, is used to support strings 5, levers 2, tuning pegs 6, leg brace 26, and harmonic bar assembly 29. Each string 5 is tuned on the player's right-hand side on the second end of the body by a geared tuning peg 6 such as is found on a guitar. Each string 5 terminates on the player's left-hand side in a ⅜" thick nylon rod 4 which is embedded in a ⅜" diameter hole 27 in the body 1 at a 100 degree angle at the first end of the body. The rods 4 enter the board 1 at the bottom of a trough 28 which is ¼" deep, ¾" wide, and 8½" long. The rods 4 are embedded to a depth of ⅞". Each string 5 enters a rod 4 at a point 1¼" above the bottom of the trough 28. The purpose of the trough 28 is to bring each string 5 closer to the surface of the board 1 while still maintaining a distance of 1¼" between the point of embedment and the string's 5 entry point into the rod 4. Each rod 4 is 4" long. Embedded concentrically into a hole in the top of each rod 4 to a depth of 1" is a length of ⅛" square brass 3. The lengths of the brass extensions 3 increase incrementally from 2¼" for the one nearest player's torso to a length of 4 7/16" in the rod 4 farthest from the player's torso. The purpose of the brass extensions is to provide additional leverage. There are eight courses of strings 5. A course comprises a lever 2 (comprising nylon and brass parts), a string 5, and a geared tuning peg 6. The lengths of the strings 5 vary incrementally from 5" to 22". The leg brace 26 is a square 6" by 6" frame of 2" deep by ½" thick wood which is bolted to the underside of the body 1, and is grasped between the knees by the seated player so as to stabilize the instrument. The harmonic bar assembly 29 comprises harmonic node-touching bar 30 and foot control 31. The harmonic node-touching bar 30 comprises lifter 17, pivot pin 20, pad support 18, harmonic node-touching pad 19, and lifter support hinge 21 . The foot control 31 comprises pedal 22, pedal support 23, pedal hinge 24, and riser 25. See FIGS. 10 and 11. The lifter 17 and pad support 18 are made of ⅜" wide by 3/16" thick wood. The node-touching pad is made of ¼" wide by 3/16" thick sponge foam. The lifter 17 and pad support 18 are joined by a metal pin 20. The lifter support hinge 21 and pedal hinge 24 are small cabinet grade hinges. The pedal 22 and pedal support 23 are made of ½" thick hardwood ply, and the riser 25 can be made of a length of cord knotted through the hole in the end of the pedal 22 and tied to the far end of pad support 18.The pad support 18 is so positioned as to touch the strings 5 lightly at their mid-points where a harmonic node is located. When these points are lightly touched so that the strings' motion is lightly obstructed at these points, the second partial is emphasized and the strings 5 will sound an octave above their open tunings. Since the most preferred embodiment is a lap instrument, the length of the riser 25 may be adjusted to the need of the individual player. In the most preferred embodiment, the strings 5 pass over an electric pick-up 8 at the middle of their lengths.

The instrument, when constructed as described, allows for a range of finger pressures from a fraction of an ounce to several pounds to be translated into pitch variations both up and down. Also, it is possible to place individual vibratos and/or glissandi on more than one string at a time while leaving other strings in their rest tunings. It is further possible to engage in these playing techniques while at the same time choosing, without the use of hands, groups of harmonics which may then have these playing techniques applied to them.

It may be noted that in this embodiment bridges are eliminated so as to reduce drag and improve tone and tuning stability. This is in consideration of the fact that on a bridged instrument the string rubs on the bridge when its tension is changed, and this affects tuning stability, especially in instances of extreme slackening and tightening. Bridges also affect tone and drain energy from the string. Because of this lack of bridges, positioning of the tuning pegs 6 and levers 2 is critical since strings 5 without bridges cannot be bent to meet the points where they terminate. Therefore, the pegs 6 must be placed in such manner that the strings 5 are close to parallel, nearly in the same plane, at the correct distance apart, and at the desired distance from the body 1. Further, the points of embedment of the strings 5 into the levers 2 must be close to mirror image symmetry with the points where the strings 5 enter the tuning pegs 6 in order for a single electric pick-up 8 to be effectively placed across the middle of all the strings 5. See FIG. 2. The pick-up 8 is set in the body 1 mid-strings, flush with the surface of the body 1.

Figure 3:
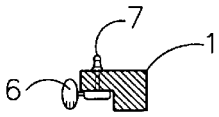
FIG. 3 is an end view cross section of the player's right hand end of the most preferred embodiment. The cross section is taken through the area where the right-hand-most tuning peg 6 is attached to the body 1 of the instrument.
Figure 4:
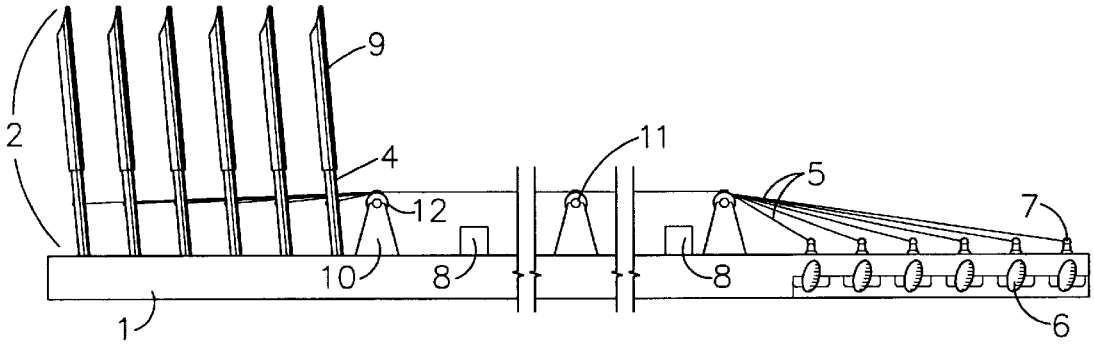
FIG. 4 is a side elevation of preferred embodiment number 2, is the side facing the player, and for clarity shows only one row of levers 2.
Figure 5:
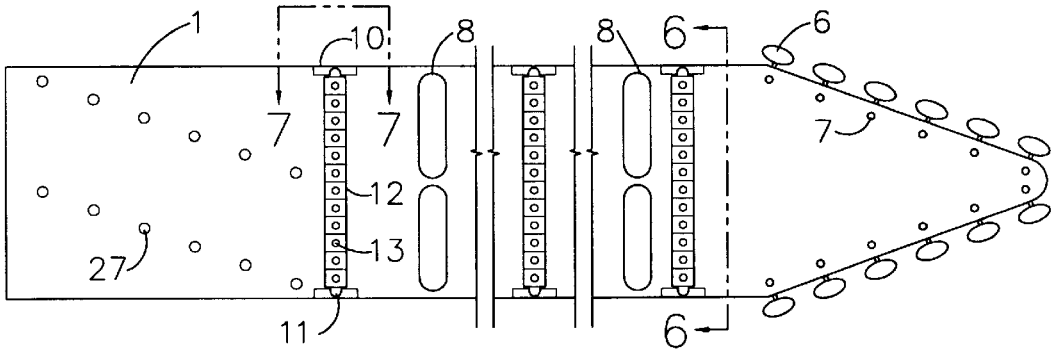
FIG. 5 is a bird's eye view of preferred embodiment number 2, excluding levers 2 and strings 5.
Figure 6:
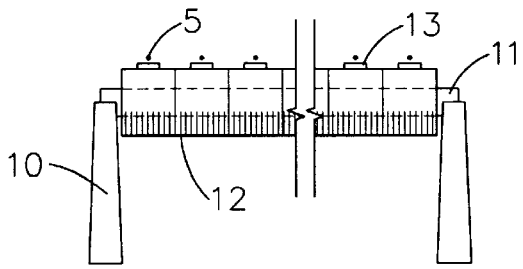
FIG. 6 is an elevation of the bridge 32 of preferred embodiment number 2.
Figure 7:
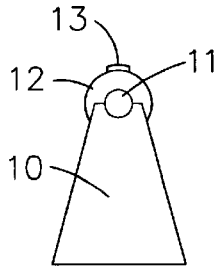
FIG. 7 is an enlarged side elevation of the bridge 32 from preferred embodiment number 2.

Refer now to FIG. 3. Each tuning peg 6 is affixed in a recessed area so that the string 5 enters the tuning peg 6 ¼" above the surface of the body. Electric pick-up 8, trough 28, levers 2, tuning pegs 6 , and string entry points into levers 2 and tuning pegs 6 are thus configured so as to: 1) eliminate the need for any object to touch the strings 5 except at their ends (harmonic nodes excepted), and 2) make it possible for a single electric pick-up 8 to be effectively placed across the middle of each of the strings 5 and perpendicular to them.

Figure 8:
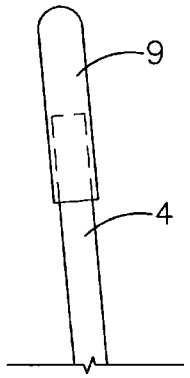
FIG. 8 is an elevation of a lever 2 from preferred embodiment number 2 as seen from the end of the instrument on the player's right.

Refer now to FIGS. 4 through 7, which represent preferred embodiment number two of the multiple stringed musical instrument a solid hardwood board 1 of 1¼" thickness is used to support twelve courses plus additional parts. Each string 5 is tuned on the player's right-hand side by a geared tuning peg 6 and terminates on the player's left-hand side in a ⅜" diameter nylon rod 4 embedded in the board at a 100 degree angle. Each string 5 enters a rod 4 1⅛" above the rod's point of embedment. Each rod 4 is 4" long and is embeded in a ⅜" diameter hole 27 in the board 1 to a depth of 1". Attached to the top of each rod 4 is a removable extension 9 overlapping the rod 4 1" and made of a 4" long sleeve of brass tubing 9 with an inner diameter of ⅜" and an outer diameter of 7/16". The free end of the tubing 9 is flattened, smoothed, and rounded to facilitate ease of handling. See FIG. 8. Each string 5 passes over three bridges 32. Each bridge 32 comprises a 5/16" diameter stainless steel rod 11 supported on each end by a wooden bridge support 10. Each steel rod 11 supports twelve rotating needle bearings 12, inner diameter 5/16" and width ⅜", and which are padded with felt 13 where the strings 5 rest upon them. The purpose of each rotating bearing 12 is to reduce friction when the string 5 is tightenened or slackened during playing, so that the bridge 32 does not hinder the string 5 from returning to its rest tuning when the lever 2 is released. See FIGS. 6 and 7. Bridge #1 is positioned at the lever end, bridge #2 is positioned at the tuning peg end, and bridge #3 is positioned in between and can be moved prior to playing so as to alter the tuning relationship between the two groups of string sections on either side of bridge #3. This arrangement of bridges 32 allows for two simultaneous rest tunings per course. The distance between bridge #1 and bridge #2 is about 22". Electric pick-ups 8 are placed on both sides of bridge #3 such that all strings 5 are monitored in both groups. It may be noted that the felt pads 13 on the needle bearings 12 do not go all the way around; the bearings 12 may be rotated so that strings 5 rest directly on bearings 12. It may also be noted that the felt pads 13 improve lateral stability of the strings 5 when the strings 5 are activated.

Figure 9:
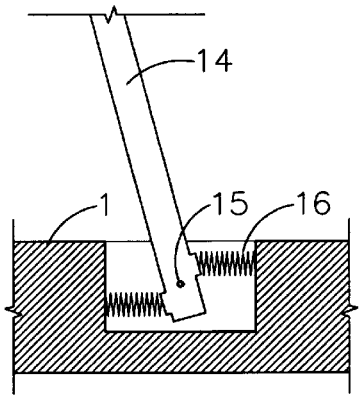
FIG. 9 is a cross section of an alternative lever 14 construction: an elevation as seen from the player's point of view.

While preferred embodiments of the present invention have been shown and described herein, such embodiments are provided as examples only. Variations in sizes and materials used, as well as in the number of strings 5 and/or harmonic bar assemblies 29, may occur without departing from the invention described herein. Further, the manner of constructing bridges 32, levers 2, and harmonic bar assemblies 29 as described herein are provided as examples only, and structural variations may occur without departing from the invention described herein. For example, harmonic node-touching bars 30 could be placed so as to touch other harmonic nodes such as those at ⅓,¼, and ⅕ the strings' lengths so as to choose an octave and a fifth, two octaves, and two octaves and a third above the open string 5. A harmonic node-touching bar 30 could be placed near the strings' insertion points into the levers 2, giving the harmonic node-touching bar 30 the function of a damper or mute. Further, other materials could be attached to the needle bearings 12 in preferred embodiment number two to effect a different tone. Refer to FIG. 9 for an example of an alternative lever 14 construction.

I claim:

1. A stringed musical instrument comprising:

a body with a first end and a second end;

a plurality of levers mounted on said first end of body, each lever conrolling the pitch change of an individual string, said levers having a first section of rod comprising nylon or other flexible synthetic material, and a second section of metal or other rigid material;

a plurality of tuning pegs mounted on said second end of body;

a plurality of strings anchored at said levers and said tuning pegs;

a harmonic node-touching bar mounted on the body under said strings, said bar being mounted between the said first end and the said second end of the body and connected to a foot pedal by a riser to enable the player to select harmonics to be played.

2. A stringed musical instrument as recited in claim number 1 which further comprises:

a plurality of bridges having rotating needle bearings padded with felt, said bridges are mounted on the body under the strings between said first end and said second end, with said strings resting on said bridges.

* * * * *